United States Patent [19]

Klein

[11] 3,980,200

[45] Sept. 14, 1976

[54] SEALANT FOR PUSHDOWN GATE IN A CAN LID

[76] Inventor: Gerald B. Klein, 13451 Stuart Court, Broomfield, Colo. 80020

[22] Filed: Aug. 18, 1975

[21] Appl. No.: 605,602

Related U.S. Application Data

[63] Continuation-in-part of Ser. No. 370,924, April 28, 1975, Pat. No. 3,905,513.

[52] U.S. Cl. ..... 220/268; 220/359

[51] Int. Cl.[2] ..... B65D 41/32

[58] Field of Search ..... 220/265–268, 220/359

[56] References Cited

UNITED STATES PATENTS

| | | | |
|---|---|---|---|
| 3,759,206 | 9/1973 | Dalli et al. | 220/268 X |
| 3,760,752 | 9/1973 | Geiger | 220/268 |
| 3,779,417 | 12/1973 | Klein | 220/268 |
| 3,881,630 | 5/1975 | Lovell et al. | 220/268 |
| 3,905,513 | 9/1975 | Klein | 220/268 |

*Primary Examiner*—George T. Hall

*Attorney, Agent, or Firm*—Dennis O. Kraft

[57] ABSTRACT

A can lid includes a push-down gate formed in a panel portion below a narrow underfolded rim in the opening in the lid. The outline of the gate at this underfold is a score cut through the panel to permit the gate to swing downwardly and into the can. This structure is essentially the same as in the Klein, Harper Pat. No. 3,334,775; however, the panel portion in the can lid includes a sealant formed of a settable liquid which, through capillary action, extends into the underfolded rim, and through the score cut to plug the opening thereof until the lid is depressed.

6 Claims, 7 Drawing Figures

SEALANT FOR PUSHDOWN GATE IN A CAN LID

The present invention is a continuation-in-part of my application for a Sealant for Pushdown Gate in a Can Lid, Ser. No. 370,924, filed Apr. 28, 1975, now U.S. Pat. No. 3,905,513 and as such, discloses subject matter of that application and also discloses and claims related subject matter. As such, this invention relates to can lids having gates in the surfaces of the lids which are pushed downwardly into the cans to open them, and more particularly to means and materials for sealing such gates until they are opened.

The invention may be used with gated can lids wherein the gate is integral with the lid and is formed at an opening or aperture in the can lid beneath an underfolded, interconnecting spacer strip about this aperture, of the type set forth in the patent issued to myself and Kenneth E. Harper, U.S. Pat. No. 3,334,775, on Aug. 8, 1967.

To form a push-down gate in a panel portion of a can lid, an important step is to cut a score line in the panel to define the outline of the gate, leaving an uncut hinge portion so that the gate may separate from the lid as by tearing at the score line, and swing about the hinge as it is pushed downwardly. The present invention comes into play where the gate is severed from the lid at this score line by cutting completely through the panel, as by an operation which may be called lancing. When the score line, or a portion of the score line is thus lanced, the gate will easily tear away from the lid at any remaining portion of the score line. However, the score line at this lanced portion must be securely sealed to prevent the contents of the can from leaking, even when the can is subject to internal pressure and/or is handled in a rough manner.

The present invention differs from the parent application previously referred to, in that it was discovered that the extent of lancing, previously described as a short portion of the score line, can be extended about a substantial portion, or all, of the score line defining the gate outline. Thus, as used herein, the terms "lancing" and "score line" are synonymous in that a lanced portion of the score line is actually a portion of the score line cut all the way through the panel of the lid.

The invention is concerned with a gated can lid where the gate is formed beneath an underfolded strip at the aperture of the opening and is pushed downwardly into the can to open it. The gate is necessarily immersed in the liquid contents of the can and accordingly, cleanliness and sanitation are important. The opening in the lid, the underfolded strip defining this opening, and the gate beneath it creates a shallow pocket which could be a trap for substances which are contaminants. Regardless of the type of gate used, contaminants may adhere to the gate surface and they may be small solid particles or drops of various types of liquids which may accidentally fall onto the gate in the can lid. If these contaminants are liquid, the liquid can seep underneath the underfolded strip and provide a medium and environment for bacterial growth.

The present invention was conceived and developed with the foregoing considerations in view and comprises, in essence, the use of a suitable inert sealer-filler which is applied to and about the gate in the can lid in such a manner as to fill the underfolded lap or channel between the gate and the lid and provide a fillet at the edge of the opening. This eliminates the possibility of contaminants seeping underneath the underfolded strip. At the same time, the sealing substance must effectively fill and seal the lanced portion of the score line defining the outline of the gate, and even flow through the lanced portion of the score line to form a plug. This flow may even extend about the entire score line and to surfaces adjacent to the score line to protect the exposed metal surface of this score line and any adjacent metal surfaces where the coating of enamel, used with can lids of this type, is ruptured or abraded during forming of the gate.

It follows that an object of the invention is to provide, in a gated can lid having a gate which underlies an aperture in the lid and which is opened by being pushed downwardly, a novel and improved arrangement of a filleted sealer-filler in the can lid aperture, which eliminates the possibility of contaminant substances being lodged therein.

Another object of the invention is to provide, in a gated can lid having a partially or fully lanced score line which extends about the periphery of the gate to permit the gate to be easily pushed downwardly into the can, a novel and simplified arrangement of a filler and sealer to effect a leakproof fit of the gate at the entire lanced portion of the score line.

Another object of the invention is to provide, in a gated can lid having a gate or a portion of a gate formed beneath an underfolded spacer strip about an aperture in the face of the can lid with the outline of the gate being defined by a lanced score line beneath this underfolded spacer strip, a novel and improved method of sealing this lid by using selected meltable or thermoplastic, or liquid thermosetting types of natural or synthetic materials as a filler-sealer to close the lanced score line in a manner which takes advantage of the capillary action of a fluid sealant to seep into the lap between the spacer strip and gate, through the lanced opening, and thence into the remainder, if any, of the score cut to effect a positive and complete seal, and which also will flow to form fillets to seal off and overlie, recessed portions of the aperture exposed to possible contaminants.

Another object of the invention is to provide in a gated can lid of the type considered, a simplified mode of sealing and filling the gated aperture, which is quick, reliable and economical.

With the foregoing and other objects in view, my present invention comprises certain constructions, combinations and arrangements of parts and elements as hereinafter described, defined in the appended claims, and illustrated in preferred embodiment by the accompanying drawing in which:

Figure 3:
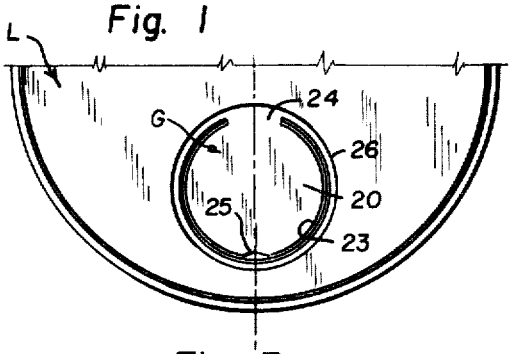
FIG. 3 is a bottom view of a portion of the can lid shown at FIG. 2 illustrating the gate panel and a score line which separates the gate from the edge of the panel underneath the aperture.
Figure 3A:
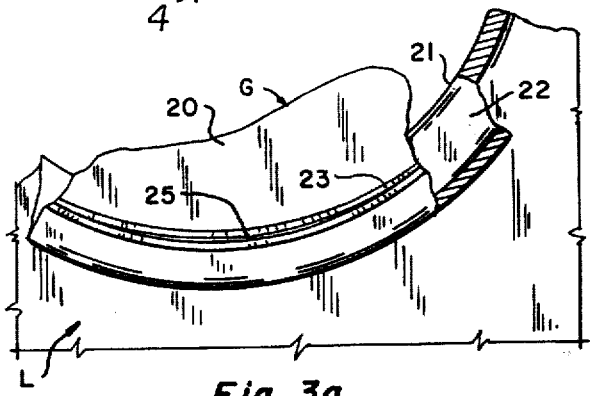

FIG. 3*a* is a fragmentary view of a portion of the showing at FIG. 3, but on a greatly enlarged scale to show the lanced score line.

Figure 1:
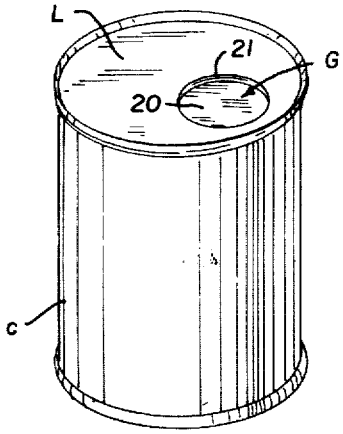
FIG. 1 is a perspective view of the can having a push-in gate formed below a round aperture with an underfold of the can lid.
Figure 2:
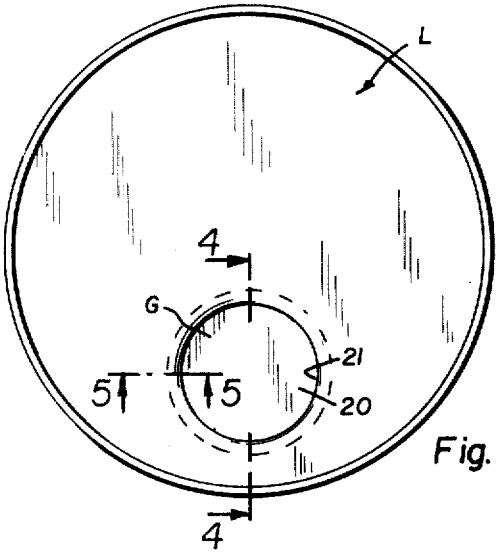
FIG. 2 is a plan view of the can illustrated at FIG. 1 to show the lid and gate therein with dotted lines indicating the outline of the gate panel beneath the aperture in the can lid.
Figure 4:
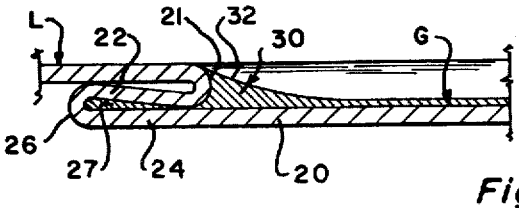
Figure 4:
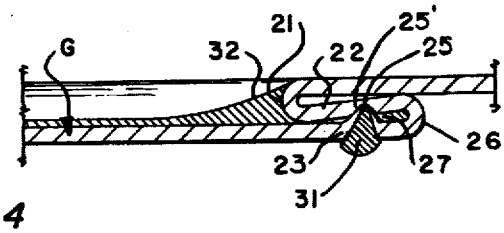

FIG. 4 is a sectional view of a fragment of the can lid as taken from the indicated line 4—4 at FIG. 2, but on a greatly enlarged scale, with portions broken away to conserve space and with a sealer-filler material within the recess formed by the gate beneath the aperture to emphasize the manner in which this sealer-filler will flow into the crease beneath the spacer strip and the gate and through the lanced portion of the score line.

Figure 5:
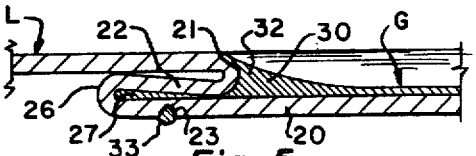

FIG. 5 is a fragmentary sectional view as taken from the indicated line 5—5 at FIG. 2 but on a greatly enlarged scale to show the manner in which the sealer-filler lies upon the gate and flows into an uncut portion of the score line at the underside of the gate.

Figure 6:
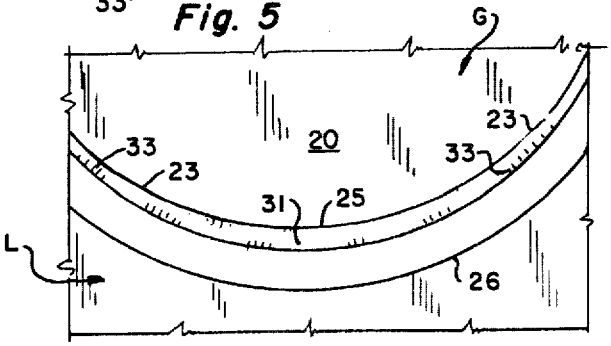

FIG. 6 is a fragmentary view similar to FIG. 3a but showing the manner in which the sealer-filler material can flow through the lanced portion to form a continuous bead at the underside of the lid.

Referring to the drawing, a typical can C is formed with a lid L which is of a common construction except for a push-in gate G in the face of the lid. In the drawing this gate and the aperture are illustrated as being circular; however, it is to be noted that the gate and aperture may be oval, U-shaped, triangular, rectangular teardrop or in any other suitable form. The gate G is integral with the can lid L and it is formed by underfolding and enlarging a portion of the lid to form a gate panel 20 beneath an opening or aperture 21 in the can lid. The underfolded gate panel 20 is separated from the lid L by a spacer strip 22 which extends beneath the can lid about the edge of the aperture and above the edge of the panel 20. The outline of the gate panel 20 is defined by a score line 23 which is cut in the underside of the panel 20 in any suitable manner, and directly beneath the spacer strip 22. As best illustrated at FIG. 3, this score line 23 terminates at each side of a hinge portion 24, which is preferably near the center of the lid. This score line may also be cut at the upper side of the panel 20, without changing the basic arrangement of the invention disclosed herein. Also, it is contemplated that the gate may be pushed downwardly into the can to separate the gate from the lid, and by tearing it away from the lid at any portion of the score line 23, which is not cut all the way through the panel. In any event, the gate will remain attached to the lid at this hinge 24.

To facilitate breaking the connection of the gate to the lid at the score line, a portion of this score line 23 is lanced or cut through, as at 25. This lanced portion 25 may be all or part of the score line 23, and at least, preferably, a substantial part of the score line opposite the hinge 24. It is to be noted that the continuity between the gate panel 20 and the outer portion of the underfold below the spacer strip 22 connnecting with the gate is not broken within the hinge nor by portions of this score line which are not cut completely through the panel. It is also to be noted that the continuity between the gate panel 20 and the outer portion of the underfold below the spacer strip 22 at the lanced portions of the score line is not disrupted until the gate panel is pushed downwardly. The operation of cutting the score line through the panel, to form the lanced opening, can effectively squeeze the cut edges into the underside of the spacer strip 22, as shown at FIG. 4, in such a manner as to produce a slight mechanical gripping of the cut edges of the gate panel against the underside of the spacer strip 22 as indicated at 25'. This gripping will in no way inhibit flow of sealant into the score line.

The spacer strip 22 results from drawing and folding the lid material to produce a gate panel 20 which is larger than the aperture 21. This provides for a rounded, smooth surfaced lid L. This is advantageous since such a fold will not cut the fingers of a person pushing the gate into the can. At the same time, the underfold beneath the spacer strip 22, wherein the gate is located, is larger in diameter than the aperture 21 with its connection to the spacer strip being an outer edge fold 26 as best illustrated at FIGS. 4 and 5. This produces a fold 27 between the top surface of the gate G and the undersurface spacer strip 22.

In the manufacture of a can lid, where the aperture structure, including the spacer strip, is drawn and folded, it is to be noted that this fold 27 cannot be completely closed with an airtight fit and accordingly, it is illustrated with a portion of the lapping surfaces being separated a short distance from each other. Actually the drawing is exaggerated somewhat for the lap or fold 27 is very narrow because the dies forming the aperture and the gate beneath it will exert considerable pressure against the lid, spacer strip and gate. However, no matter how tightly the spacer strip bears against the gate panel, liquids which adhere to the surface of the material forming this lid and panel can seep between the two members by capillary action. Such liquids may be contaminating fluids such as dirty water or the like and if a drop of such a liquid were to fall into the gate aperture, it would seep into this space and thence into the can when the gate is opened. Also, small particles such as dust, filings or the like can be lodged in the aperture against the edge of the spacer strip 22. Therefore, it is important to provide a means to prevent such from occurring, because the gate must be clean and sanitary.

The present invention contemplates placing a liquid sealer-filler 30 in the aperture 21, above the gate, which will flow into the fold 27 between the spacer strip 22 and the edge of the gate panel G and also flow onto the lanced portion 25 of the score line 23 to form a plug 31 to seal off this opening, as hereinafter further described. This sealer-filler must then set and harden to produce a smooth surfaced fillet 32 about the edge of the aperture which encloses the fold of metal at this edge 21. The fillet 32 will prevent contaminant liquids from seeping into the lap and also prevent small solids from lodging against this aperture edge. If desired, a sufficient amount of sealer-filler material may be provided to completely fill this aperture.

An ideal material for the sealer-filler may be selected from a number of different types of paraffin waxes which are commonly available. One suitable type is micro-crystalline paraffin wax. Paraffin waxes are petroleum products and may be refined to the point where substantially all oils have been removed and the comparatively pure wax is white, odorless, tasteless and practically impervious to moisture. As such, paraffin waxes are widely used in the food and beverage industries for lining containers. These waxes will melt at various ranges of temperatures, to a liquid of low viscosity which has good adhesion and adsorption to metal surfaces. Paraffin and other types of synthetic or natural waxes are commonly blended together to attain a selected degree of hardness and resistance to cold flow when they cool and set. A technician skilled in the art can select various waxes and wax blends, suitable for the purpose at hand.

Other materials, such as natural and synthetic resins, are also suitable for the filler-sealer. For example, a number of polymeric sealants are known, such as a thermosetting polyepoxide or a thermoplastic ethylene vinyl acetate copolymer. Such materials, and also hot melt adhesives, must be meltable to a liquid or be liquid in an initial state. The liquid must have a low viscosity and an affinity for the metal or coated metal forming the lid and gate to produce the needed capillary action to form the fillet 32 to permit it to flow into the closely spaced fold 27 between the spacer strip 22 and gate surface and thence into the lance opening 25. This material must then harden and set to a stiffness sufficient to resist the pressures within the can to prevent a flowback or leakage at the opening 25. Finally, the material must be acceptable for use in connection with beverages and foods. A skilled technician can easily select suitable resins for the purpose at hand knowing the conditions above stated.

The metals commonly used in the manufacture of can lids include aluminum and steel. Thus, paraffin waxes are preferred for a sealer-filler material since they have good affinity for, and good adhesion with these metals and conventional can lining materials, usually lacquers or enamels.

When the sealer-filler consists of a wax-like material which must be melted, its application includes the steps of heating the can lid to a selected temperature to permit the wax to melt and flow in place. This heating of the can lid may be one of the final steps in the manufacture of the lid and it can be accomplished in any suitable method such as passing the lid through an oven, with infra-red radiation, placing the lid upon a heat source plate, flame heating or heating by electrical induction methods. It is important that the lids be heated quickly since they are ordinarily produced at a great rate and a skilled operator can select the best mode of heating the lids for any given production operation. The wax may be pre-melted or a small pellet of wax may be placed on the heated lid, in the aperture, to melt and flow to the edges of the aperture and underneath the lap 27 by capillary action. Thereafter, the lids will be cooled to permit the wax to set to complete the operation.

When a micro-crystalline wax was used to seal can lids, as above described, it was discovered that the flow of wax was remarkably uniform and that wax which would flow into the fold 27 by capillary action would easily and rapidly flow through the score line lance 25 and into any uncut portion of the score line 23 about the edge of the gate as a bead 33, FIG. 5, which overlays the exposed metal in the score line. It was further ascertained that if a fluxing agent were used, the wax would not only follow the score line where exposed metal existed, but would also spread about the undersurface of the gate and lid where the fluxing agent was applied.

Such a flux may be applied during the operations of drawing and shaping the can lid to form the aperture 21, the spacer strip and the gate beneath the lid because it is necessary to use a lubricant on the dies which form the gate beneath the lid and such lubricant may be the fluxing agent. A naphtha-wax blend is a commonly used type of lubricant and is a good fluxing agent which will permit the paraffin to flow over a selected area at each side of the score line, as hereinafter further described. Such a fluxing agent, a naphtha-wax blend, can also be printed onto a selected portion of the undersurface of the can lid.

Where a thermosetting type of a synthetic resin plastic is used to effect a seal, such as with a two component thermosetting resin such as a polyepoxide which is initially in a liquid phase but which will thereafter set up, the same simple procedure may be used. A drop of the liquid resin is placed in the aperture to flow into the lap 27 and thence into the lance opening 25. However, since the resin liquid might be comparatively viscous, it may be necessary to supplement this natural flow with a suitable pressure action. Pressure or a vacuum may be applied to one side of the lid in any suitable manner which is not herein shown. Thereafter, the liquid resin will be permitted to set into a hard resistant material, either by heat action or through reactions over a lapse of time, according to conventional practice. It is to be noted that when a material other than a paraffin wax is used, the flow of material from the gate and into the raw metal score line may not be very effective and hence, a respray operation which applies a thin coating of paraffin, or other coating conventional in can making practices, to the underside of the lid may be necessary.

An important factor in the present invention resides in the extent and the location of the lanced opening 25 of the score line 23. The lapped fold 27 for the spacer strip 22 forms a backing surface at the fold. Thus, a plug 31 in the lanced opening of the score line is reinforced by the lap 22 to withstand pressure within the can. This becomes important for, should the opening 25 be located in a portion of the lid where another closely lapped backing surface does not exist, the plug 31, formed by the wax seal, could not resist the shear forces produced by any substantial pressure within the can. After a short period of time, such a plug-like seal would give way. However, with the closely lapped backing surface, exemplified at FIG. 4, the wax plug 31, to fail, must first flow between two closely spaced surfaces, the spacer strip 22 and the gate panel G, before giving way. Moreover, pressure within the can will tend to squeeze these surfaces together. Thus, the plug 25 can resist substantial pressures within the can.

I have now described my invention in considerable detail. However, it is obvious that others skilled in the art can build and devise alternate and equivalent constructions which are nevertheless within the spirit and scope of my invention. Hence, I desire that my protection be limited not by the constructions illustrated and described, but only by the proper scope of the appended claims.

What is claimed is:

1. In a can lid having a panel below the lid and at an opening defined by an underfolded edge of the lid, said panel constituting a pushdown gate defined by a score line at the edge of the panel underneath the underfolded edge of the lid, wherein at least a substantial portion of said score line is lanced through to permit separation of the gate from the lid and to facilitate the tearing and severing of any remaining unlanced portion of the score line when the gate is pushed downwardly, the improvement comprising:

a wax-like sealer-filler of a type which may be obtained as a settable fluid, extended continuously about the opening defined by the underfolded edge of the lid as a fillet, between the underfolded edge of the gate and the panel surface thereunder as a capillary layer and in the lanced opening as a plug.

2. In the organization defined in claim 1 wherein:

the sealer-filler is a blend of paraffin waxes.

3. In the organization defined in claim 1 wherein:

the sealer-filler is a polymeric sealant having the general characteristics of a thermo-setting poly epoxy which may be applied to the lid in a liquid state to facilitate the flowing of the same into the lanced opening and between the lapping surfaces through capillary action.

4. In the organization defined in claim 1 wherein:

the sealer-filler is a polymeric sealant having the general characteristics of a thermo-plastic ethylene vinyl acetate copolymer which may be heated to a liquid state and applied to the can lid to permit the same to flow between the lapped surfaces and thence into the lanced opening by capillary action.

5. In the organization defined in claim 1 wherein:

the score line is at the underside of the lid and said sealer-filler plug extends through the lanced opening and into the score line.

6. In the organization defined in claim 1 wherein:

the sealer-filler is a hot melt adhesive.

* * * * *